US010173444B2

(12) United States Patent
Kamei

(10) Patent No.: US 10,173,444 B2
(45) Date of Patent: Jan. 8, 2019

(54) PRINTER AND METHOD OF PRINTING

(71) Applicant: CASIO COMPUTER CO., LTD., Tokyo (JP)

(72) Inventor: Koichi Kamei, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/610,970

(22) Filed: Jun. 1, 2017

(65) Prior Publication Data

US 2018/0001676 A1 Jan. 4, 2018

(30) Foreign Application Priority Data

Jun. 30, 2016 (JP) ..... 2016-131146

(51) Int. Cl.
*B41J 11/70* (2006.01)
*B41J 3/407* (2006.01)

(52) U.S. Cl.
CPC ..... *B41J 11/70* (2013.01); *B41J 3/4075* (2013.01)

(58) Field of Classification Search
CPC ..... B41J 3/4075; B41J 11/703; B41J 11/666; B41J 11/66; B41J 11/663; B26D 2007/0062; B26D 2007/0081; B26D 2007/0068
See application file for complete search history.

(56) References Cited

U.S. PATENT DOCUMENTS

| | | | | | |
|---|---|---|---|---|---|
| 5,562,009 | A * | 10/1996 | Long | B26D 3/10 | 83/110 |
| 5,823,694 | A * | 10/1998 | Ikegami | B41J 3/4075 | 400/621 |
| 5,913,624 | A * | 6/1999 | Ikegami | B41J 11/703 | 400/615.2 |
| 6,116,132 | A * | 9/2000 | Kamijo | B26D 1/0006 | 83/599 |
| 9,145,008 | B2 * | 9/2015 | Nakajima | B41J 11/663 | |
| 9,604,426 | B2 * | 3/2017 | Totani | B26D 3/10 | |
| 9,821,575 | B2 * | 11/2017 | Nakajima | B41J 11/663 | |
| 2002/0085870 | A1 * | 7/2002 | Konishi | B41J 3/4075 | 400/76 |

FOREIGN PATENT DOCUMENTS

| | | | | |
|---|---|---|---|---|
| CA | 2769737 | * | 9/2011 | B26D 3/10 |
| JP | 03-197124 | * | 8/1991 | B31B 1/14 |
| JP | 03-278973 | * | 10/1991 | B41J 11/70 |
| JP | 2805515 | * | 9/1998 | B31B 70/36 |
| JP | 2007-176052 | A | 7/2007 | |
| JP | 2008-114552 | * | 5/2008 | B41J 11/70 |
| JP | 2011-201255 | * | 10/2011 | B31B 23/14 |

* cited by examiner

*Primary Examiner* — Huan Tran
(74) *Attorney, Agent, or Firm* — Chen Yoshimura LLP

(57) ABSTRACT

A printer includes a conveying device that conveys a printing medium and a cutting device that makes a trim cut in at least one of a plurality of corners of a region where a printed material has been printed. The conveying device conveys the printing medium to the cutting device before the cut is made.

12 Claims, 15 Drawing Sheets

Only half cuts (HC)

Change to half cut (HC) only
during middle of half cut (HC) & trim cut (TC)
(creation of blank portion (m))

PRINTER AND METHOD OF PRINTING

BACKGROUND OF THE INVENTION

1. Field of the Invention

The present invention relates to a printer and a method of printing for making printed materials.

2. Description of the Related Art

Label printers are a conventionally well-known technology for making labels (printed materials) by printing arbitrary text, graphics, patterns, and the like on an elongated printing medium and then cutting the printed portion from the printing medium.

One well-known type of such a label printer includes a half-cutting device for making half cuts (that is, by cutting only the base material of a printing medium that includes a base material having an adhesive surface and a peelable release paper that covers the adhesive surface) and a full-cutting device for making full cuts (that is, by cutting both the base material and the release paper) in order to separate the label from the printing medium (see Patent Document 1, for example).

RELATED ART DOCUMENT

Patent Document

Patent Document 1: Japanese Patent Application Laid-Open Publication No. 2007-176052

SUMMARY OF THE INVENTION

When the label described above is formed to have a rectangular shape and then applied to a target object, the labels sometimes begins to peel from the target object starting from the right angle-shaped corners.

One method of making the label less prone to peeling from the target object is to trim off the corners of the rectangular label before applying the label to the target object. Moreover, in some cases the user may want to form the corners of the label to have an arbitrary shape such as an arc shape instead of the right-angle shape.

However, trimming off the corners of the labels requires the user to do so manually using scissors or the like after making the labels. Moreover, performing this task for all four corners of every label is extremely time-intensive.

Meanwhile, when a plurality of labels are made sequentially and separated from one another by full cuts, the cut labels sometimes remain at the position at which the full cut was made, and then cause resistance as the printing medium is conveyed, which can eventually result in a jam. One technique for solving this is to leave the made labels connected but partially separated from one another (by partial cuts) so that the printing medium can easily be torn by hand. Next, this technique will be described with reference to a method of printing according to a conventional technology.

FIGS. 27 to 29 are explanatory drawings for explaining the method of printing according to the conventional technology.

As illustrated in FIG. 27, a printing medium M includes a base material Ma having an adhesive surface and a peelable release paper (sheet) Mb that covers the adhesive surface, which are layered on one another in the thickness direction (the Z direction). A partial-cutting device 50 makes partial cuts, over a flat plate P, through a portion of the center of the printing medium M in the width direction thereof (the Y direction) that is orthogonal to the lengthwise direction thereof (the X direction; the conveyance direction).

In this way, as illustrated in FIG. 28, uncut portions Ma-1, Ma-2, Mb-1, and Mb-2 are left remaining on both ends of the base material Ma and the release paper Mb of the printing medium M in the width direction thereof (the Y direction). Note that for convenience, in FIG. 28 the base material Ma and the release paper Mb are illustrated separated from one another in order to better show the partial cut PC.

Moreover, before the partial cut is made, the text "ABCDE" as illustrated in FIG. 29, for example, is printed in each of the regions of the printing medium M where the labels will be made, although this text is not illustrated in FIGS. 27 and 28.

As illustrated in FIG. 29, to separate the labels L51 and L52 made from the base material Ma of the printing medium M from one another, if only the one label L51 has been fed out of the label printer, the user simply grasps and pulls off that one label L51. If both labels L51 and L52 have been fed out of the label printer, the user grasps the two labels L51 and L52 on either side of the partial cut PC and then pulls them apart from one another.

In this way, the two labels L51 and L52 (the base material Ma) are separated from one another along with the release paper Mb at the ends (Ma-1', Ma-2', Mb-1', and Mb-2') near the uncut portions Ma-1, Ma-2, Mb-1, and Mb-2 where the printing medium M extends in the pulling direction. When the labels L51 and L52 are pulled apart in this manner, the corners of the labels L51 and L52 tend to deform from the right-angle shape to another shape.

The present invention therefore aims to provide a printer and a method of printing that make it possible to give a desired shape to the corners of the printed materials that are made.

Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a printer, including: a cutting device that makes a trim cut in at least one of a plurality of corners of a region of a printing medium that has been printed on and that becomes a printed material when separated; and a conveying device that conveys the printing medium to the cutting device before the cut is made.

In another aspect, the present disclosure provides a printer, including: a conveying device that conveys, in a conveyance direction, a printing medium that includes a base material having an adhesive surface and a surface opposite to the adhesive surface where the printing is performed, and a release sheet that is peelable and covers the adhesive surface; a first cutting device that makes a half cut on the printing medium, spanning an entirety of the printing medium in a width direction that is orthogonal to the conveyance direction, the half cut cutting only the base material of the printing medium; and a second cutting device that makes, in at least the release sheet of the printing medium, a partial cut in a portion in the width direction of the printing medium at a same position in the conveyance direction relative to a position at which the half cut is made.

In another aspect, the present disclosure provides a method of controlling a printer, wherein the printer includes a cutting device that makes a trim cut in at least one of a plurality of corners of a region of a printing medium that has been printed on and that becomes a printed material when separated, the method including: a conveying step of conveying the printing medium to the cutting device before the cut is made; and a trim-cutting step of making the trim cut, via the cutting device, in the region of the printed material on the printing medium that was conveyed in the conveying step.

It is to be understood that both the foregoing general description and the following detailed description are exemplary and explanatory, and are intended to provide further explanation of the invention as claimed.

DETAILED DESCRIPTION OF EMBODIMENTS

Next, a printer and a method of printing according to Embodiment 1 and Embodiment 2 of the present invention will be described with reference to figures.

<Embodiment 1>

Figure 1:
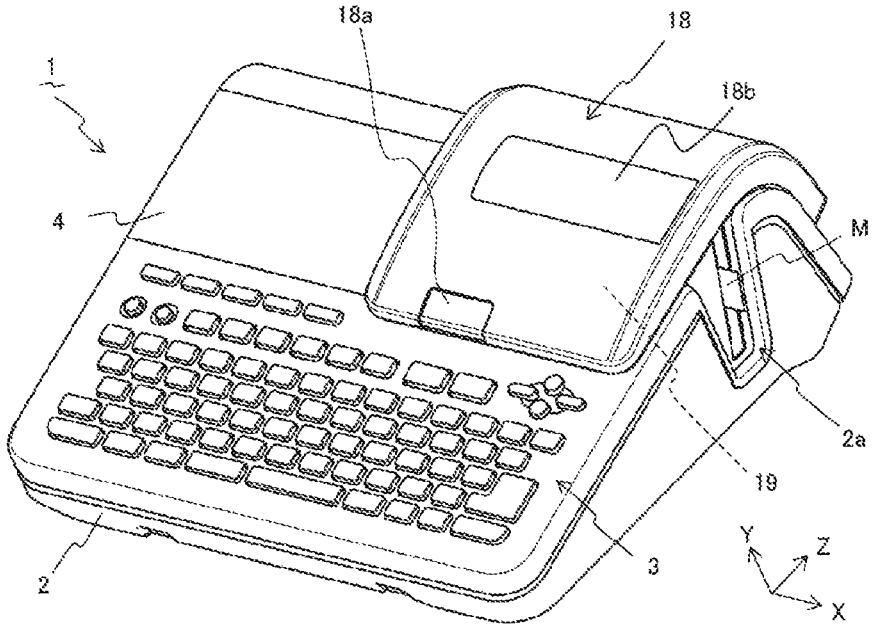
FIG. 1 is a perspective view illustrating a printer according to Embodiment 1.

FIG. 1 is a perspective view illustrating a printer 1 according to Embodiment 1.

The printer 1 illustrated in FIG. 1 is a label printer that prints using a single-pass scheme, for example, and includes a thermal head 10 (which is an example of a printing device that prints on an elongated printing medium M).

The printing medium M is a tape that includes a base material Ma having an adhesive surface and a peelable release paper (sheet) Mb that covers the adhesive surface, for example.

Moreover, the thermal head 10 prints on the surface of the base material Ma on the side opposite to the adhesive surface in order to make labels (an example of a printed material).

Below, a thermal transfer label printer that uses an ink ribbon is described as an example, but the printing scheme is not particularly limited, and a thermal printing scheme that utilizes thermal paper may alternatively be used, for example.

As illustrated in FIG. 1, the printer 1 includes a case 2, an input device 3, a display device 4, an opening/closing lid 18, and a cassette compartment 19.

The input device 3, the display device 4, and the opening/closing lid 18 are arranged on the top surface of the case 2.

Moreover, the case 2 includes various components that are not illustrated in the figure such as a power cord connection terminal, an external device connection terminal, and a storage media insertion port.

The input device 3 includes various keys such as input keys, directional keys, conversion keys, and confirmation keys. The display device 4 is a liquid crystal display panel, for example, and displays text and the like corresponding to the input from the input device 3, selection menus for selecting various settings, messages related to various processes, and the like.

Moreover, during printing, the display device 4 displays the content (hereinafter, "printing content") such as text and graphics that was specified to be printed on the printing medium M and may also display the progress of the printing process.

Furthermore, the display device 4 may include a touch panel unit, in which case the display device 4 may be regarded as being part of the input device 3.

The opening/closing lid 18 is openably/closably arranged on top of the cassette compartment 19. The opening/closing lid 18 can be opened by pressing a button 18*a*.

A window 18*b* is formed in the opening/closing lid 18 in order to make it possible to visually check whether a tape cassette 30 (see FIG. 2) is currently housed in the cassette compartment 19 even when the opening/closing lid 18 is closed.

Moreover, a feedout port 2*a* is formed in the side face of the case 2. The printing medium M that is printed on inside of the printer 1 is fed to outside of the device via this feedout port 2*a*.

Figure 2:
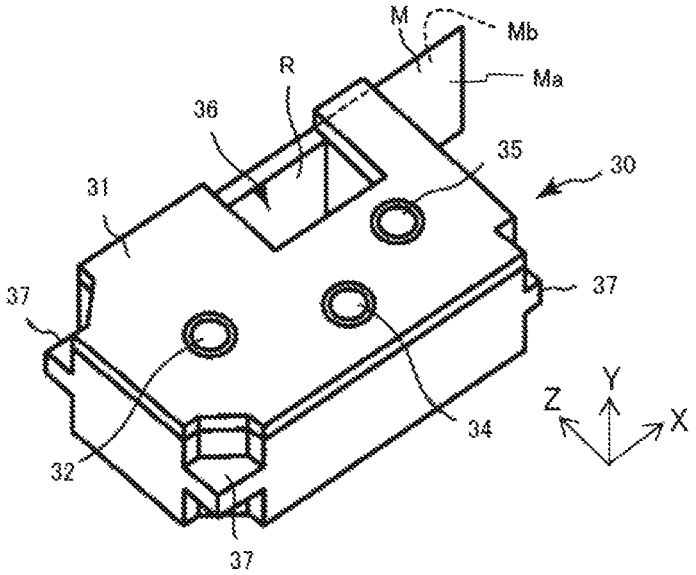
FIG. 2 is a perspective view illustrating a tape cassette housed in the printer according to Embodiment 1.

FIG. 2 is a perspective view illustrating the tape cassette 30 housed in the printer 1.

Figure 3:
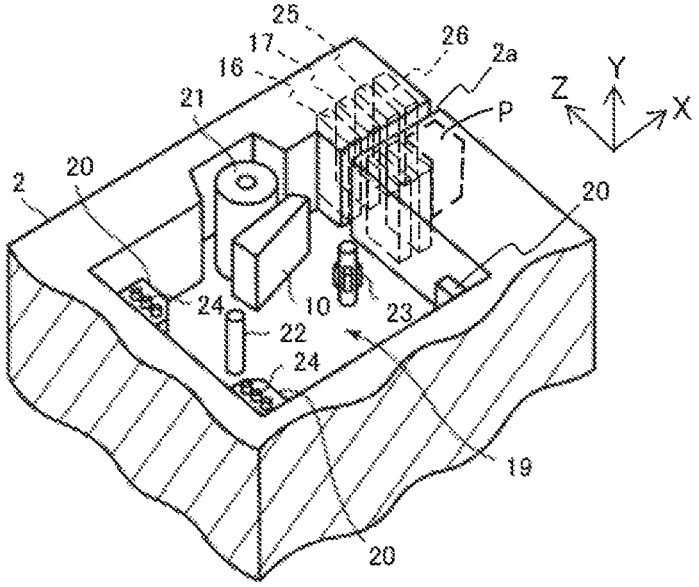
FIG. 3 is a perspective view illustrating a cassette compartment in the printer according to Embodiment 1.

FIG. 3 is a perspective view illustrating the cassette compartment 19 in the printer 1.

Figure 4:
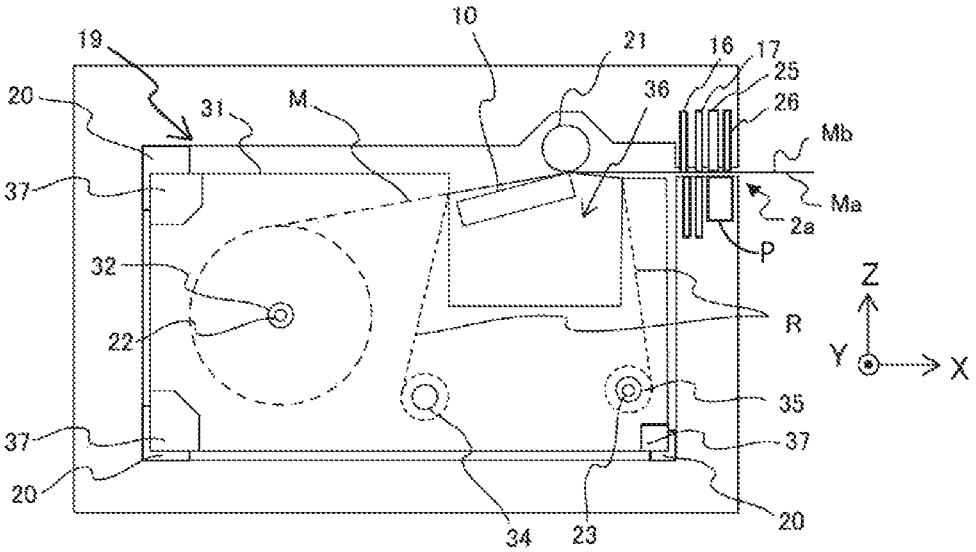
FIG. 4 is a cross-sectional view illustrating the printer according to Embodiment 1.

FIG. 4 is a cross-sectional view illustrating the printer 1.

The tape cassette 30 illustrated in FIG. 2 is removably housed within the cassette compartment 19 illustrated in FIG. 3.

FIG. 4 depicts a state in which the tape cassette 30 is currently housed within the cassette compartment 19.

Note that in FIGS. 1 to 4 and FIGS. 6 to 10 (described later), the X direction is the direction in which the printing medium M is conveyed (hereinafter, simply "conveyance direction"), the Y direction is the width direction of the printing medium M (hereinafter, simply "width direction") that is orthogonal to the conveyance direction, and the Z direction is the direction (here, the thickness direction of the printing medium M) that is orthogonal to both the conveyance direction (the X direction) and the width direction (the Y direction). Here, the X direction, Y direction, and Z direction are mutually orthogonal to one another.

As illustrated in FIG. 2, the tape cassette 30 includes a cassette case 31 in which a thermal head insertion region 36 and engagement portions 37 are formed.

The cassette case 31 stores the printing medium M and an ink ribbon R. The cassette case 31 includes a tape core 32, an ink ribbon supply core 34, and an ink ribbon winding core 35.

The printing medium M is wound in a roll around the tape core 32 inside of the cassette case 31.

Moreover, the thermal transfer ink ribbon R is wound in a roll around the ink ribbon supply core 34 inside of the cassette case 31, with the leading end being wound around the ink ribbon winding core 35.

As illustrated in FIG. 3, a plurality of cassette-receiving portions 20 for supporting the tape cassette 30 at prescribed positions are formed inside of the cassette compartment 19 in the case 2.

These cassette-receiving portions 20 include tape width detection switches 24 that automatically detect the type of tape cassette (that is, the tape width of the printing medium M) by detecting the shape of protrusions and recesses formed in the tape cassette 30.

Furthermore, the thermal head 10 (an example of a printing device that prints on the printing medium M), a platen roller 21 (an example of a conveying device that conveys the printing medium M), a tape core-engaging axle 22, and an ink ribbon winding driver axle 23 are arranged inside of the cassette compartment 19.

As illustrated in FIG. 4, when the tape cassette 30 is housed within the cassette compartment 19, the engagement portions 37 formed in the cassette case 31 are supported by the cassette-receiving portions 20 formed in the cassette compartment 19, and the thermal head 10 is inserted into the thermal head insertion region 36 formed in the cassette case 31.

Moreover, the tape core 32 of the tape cassette 30 is fitted onto the tape core-engaging axle 22, and the ink ribbon winding core 35 is fitted onto the ink ribbon winding driver axle 23.

Once a printing instruction is input to the printer 1, the printing medium M is drawn out from the tape core 32 by the rotation of the platen roller 21.

Here, the ink ribbon winding driver axle 23 rotates in sync with the platen roller 21 so that the ink ribbon R is drawn out from the ink ribbon supply core 34 in unison with the printing medium M.

In this way, the printing medium M and the ink ribbon R are conveyed along in an overlapping manner. Then, the thermal head 10 heats the ink ribbon R as the ink ribbon R passes between the thermal head 10 and the platen roller 21 in order to transfer the ink onto the printing medium M and thereby print on the printing medium M.

The used ink ribbon R that has passed between the thermal head 10 and the platen roller 21 is then wound around the ink ribbon winding core 35.

Meanwhile, the printed printing medium M that has passed between the thermal head 10 and the platen roller 21 is cut by a full-cutting device 16 and a half-cutting device 17 and then fed out through the feedout port 2*a*.

Here, the printed printing medium M that has passed between the thermal head 10 and the platen roller 21 is fed out through the feedout port 2*a* after being cut by one or more cutting devices among the full-cutting device 16, the half-cutting device 17 (an example of a half-cutting unit), a trim-cutting device (cutting device) 25, and a partial-cutting device 26 that are arranged on the conveyance path and are selected according to the configured settings. This will be described in more detail later.

The full-cutting device 16 makes "full cuts," which refers to the operation of cutting through both the base material Ma and the release paper Mb of the printing medium M in the width direction thereof (the Y direction).

The half-cutting device 17 makes "half cuts," which refers to the operation of cutting through just the base material Ma of the printing medium M in the width direction thereof (the Y direction).

Moreover, the trim-cutting device 25 makes "trim cuts," which refers to the operation of cutting, over a flat plate P and in a desired shape such as an arc shape, at least one of a plurality of corners of regions of the printing medium M where labels L1 and L2 illustrated in FIG. 13 will be made from the printing medium M. Note that here, the trim-cutting device 25 only makes trim cuts in the base material Ma of the printing medium M, for example.

Furthermore, the partial-cutting device 26 makes "partial cuts," which refers to the operation of cutting, over the flat plate P and in the width direction (the Y direction), through a portion of the printing medium in the width direction thereof (the Y direction).

Figure 5:
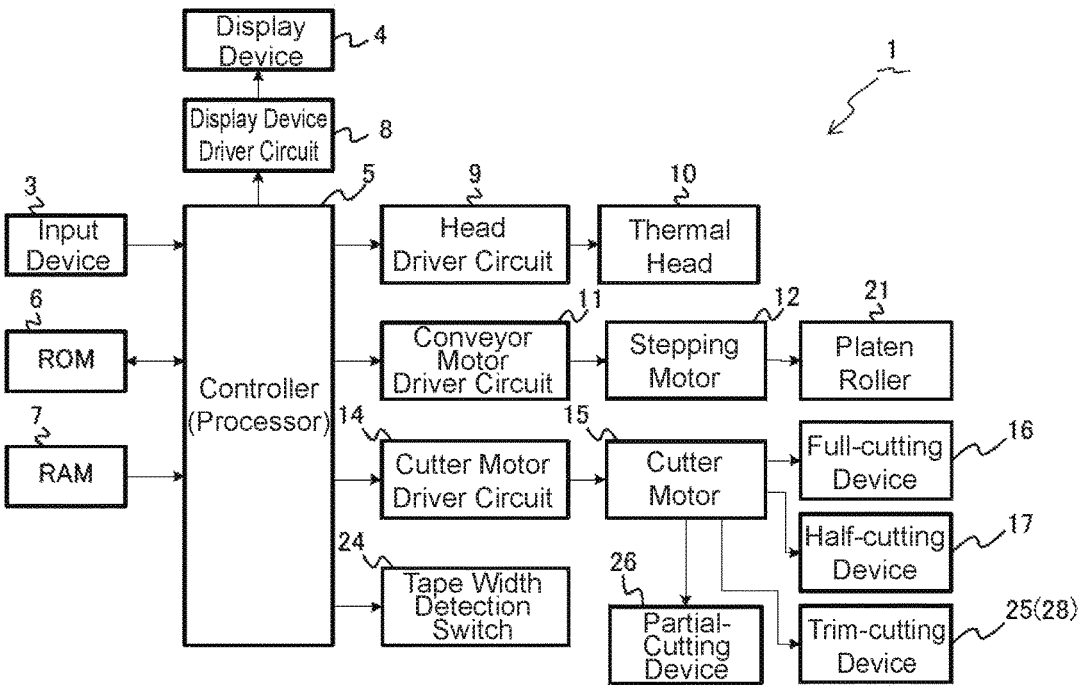
FIG. 5 is a control block diagram illustrating the printer according to Embodiment 1.

FIG. 5 is a control block diagram illustrating the printer 1.

As illustrated in FIG. 5, the printer 1 includes the input device 3, the display device 4, the thermal head 10, the full-cutting device 16, the half-cutting device 17, the platen roller 21, the tape width detection switches 24, the trim-cutting device 25, and the partial-cutting device 26 as described above, as well as a controller 5 (processor), a read-only memory (ROM) 6, a random-access memory (RAM) 7, a head driver circuit 9, a conveyor motor driver circuit 11, a stepping motor 12, a cutter motor driver circuit 14, and a cutter motor 15.

Here, the controller 5, the ROM 6, and the RAM 7 form a computer of the printer 1.

The controller 5 is a processor such as a microprocessor, for example. The controller 5 transfers programs stored in the ROM 6 to the RAM 7 and then executes those programs in order to control the operation of the circuit components of the printer 1.

The ROM 6 stores printing programs for printing on the printing medium M, various types of data needed to execute the printing programs (such as fonts, for example), and the like. The ROM 6 also functions as a storage medium that stores programs that can be read by the controller 5.

The RAM 7 functions as an input data memory that stores information about the printing content to be printed on the printing medium M. The RAM 7 also functions as a printing data memory that stores printing pattern data (hereinafter, "printing data") that represents the printing content and is generated in accordance with information about the printing content that was input. Moreover, the RAM 7 also functions as a display data memory that stores display data representing the printing content.

A display device driver circuit 8 controls the display device 4 in accordance with the display data stored in the RAM 7. Under the control of the display device driver circuit 8, the display device 4 may display the printing content with the progress of the printing process also being shown, for example.

The head driver circuit 9 controls the thermal head 10 in accordance with the printing data stored in the RAM 7. The thermal head 10 is a printhead that includes a plurality of heating elements arranged in a primary scanning direction, for example. Under the control of the head driver circuit 9, the thermal head 10 selectively passes current through the plurality of heating elements in accordance with the printing data in order to print line by line on the printing medium M by means of thermal transfer.

The conveyor motor driver circuit 11 controls the stepping motor 12. The stepping motor 12 drives the platen roller 21. The platen roller 21 rotates using the power supplied by the stepping motor 12 and thereby conveys the printing medium M in the conveyance direction thereof (the X direction; a secondary scanning direction).

The cutter motor driver circuit 14 controls one or more of the cutter motors 15. The full-cutting device 16, the half-cutting device 17, the trim-cutting device 25, and the partial-cutting device 26 operate using the power supplied by the cutter motor 15.

Figure 6:
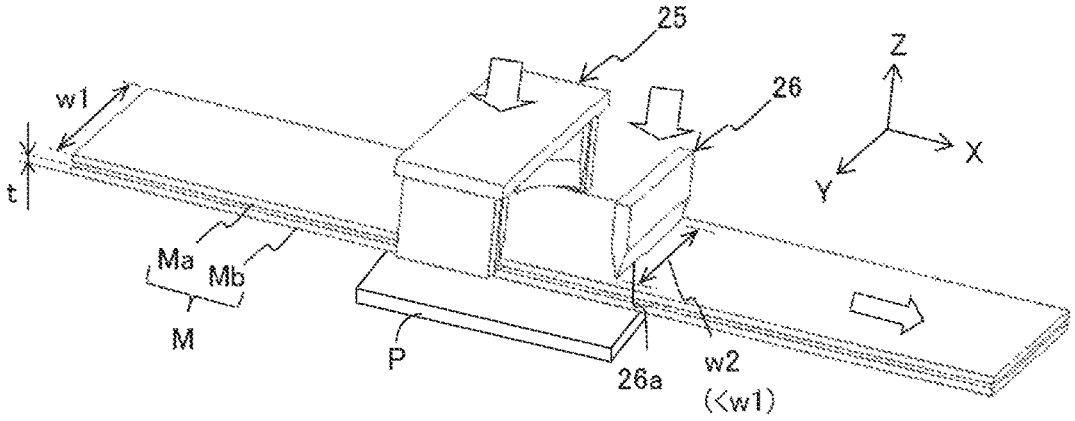
FIG. 6 is a perspective view illustrating a trim-cutting device and a partial-cutting device in Embodiment 1.

FIG. 6 is a perspective view illustrating the trim-cutting device 25 and the partial-cutting device 26.

Figure 7:
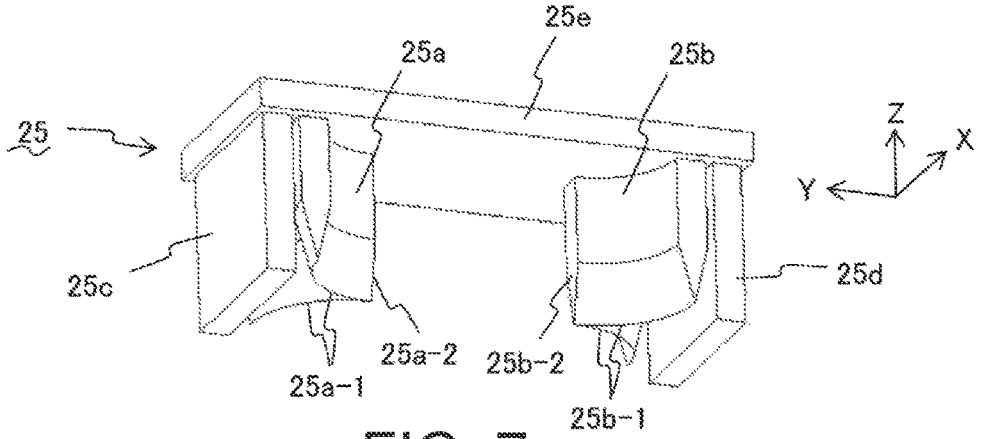
FIG. 7 is a lower perspective view illustrating the trim-cutting device in Embodiment 1.
Figure 8:
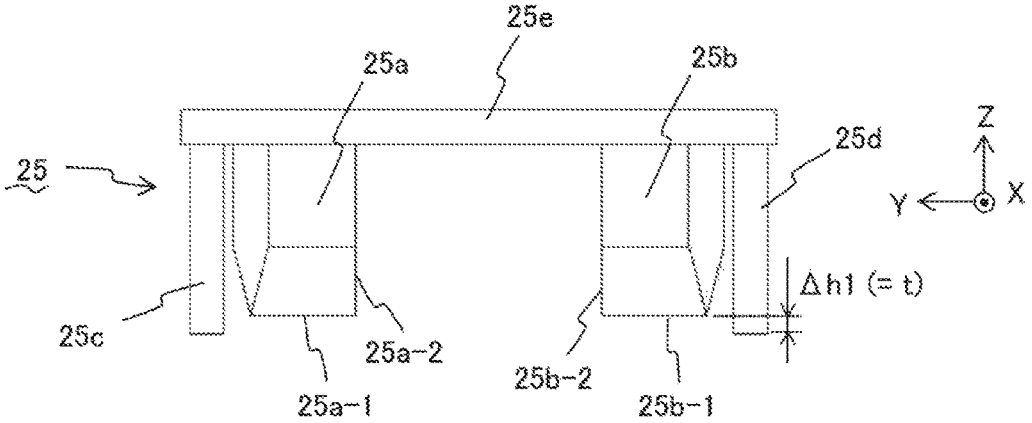
FIG. 8 is a front view illustrating the trim-cutting device in Embodiment 1.

FIGS. 7 and 8 are a lower perspective view and a front view illustrating the trim-cutting device 25.

FIGS. 9 to 13 are explanatory drawings for explaining a method of printing according to Embodiment 1.

As illustrated in FIGS. 7 and 8, the trim-cutting device 25 includes a pair of trim cutters 25*a* and 25*b* arranged facing one another in the width direction (the Y direction), a pair of stoppers 25*c* and 25*d* arranged facing one another in the width direction (the Y direction) and sandwiching the trim cutters 25*a* and 25*b*, and a top plate 25*e*.

The pair of trim cutters 25*a* and 25*b* simultaneously cut, into arc shapes (rounded shapes), the respective corners on both ends in the width direction (the Y direction) of two adjacent regions of the printing medium M where labels will be made. When viewed from the bottom surface side (that is, from the Z direction), the pair of trim cutters 25*a* and 25*b* are tapered towards one another (that is, moving inwards).

Moreover, the widths of the pair of trim cutters 25*a* and 25*b* in the X direction respectively decrease moving from the sides near the pair of stoppers 25*c* and 25*d* (the outer sides) towards the tips 25*a*-2 and 25*b*-2 (that is, inwards towards one another).

The amount of decrease in these widths becomes increasingly less pronounced moving inwards. Furthermore, the intersections between cutting edges 25*a*-1 and 25*b*-1 and the tips 25*a*-2 and 25*b*-2 of the pair of trim cutters 25*a* and 25*b* are tapered to a point and thus have substantially no width in the conveyance direction (the X direction).

The pair of trim cutters 25*a* and 25*b* respectively cut, along the portions of the cutting edges 25*a*-1 and 25*b*-1 that include these intersections, both ends of the printing medium M in the width direction (the Y direction).

As illustrated in FIG. 8, the pair of stoppers 25*c* and 25*d* protrude further downwards (in the Z direction) than the pair of trim cutters 25*a* and 25*b* by a height Δh1. This height Δh1 is equal to the thickness tin the Z direction of the release paper Mb illustrated in FIG. 6. Therefore, when the trimming device 25 is lowered to make a cut, the pair of stoppers 25*c* and 25*d* contact the cutter receiver/flat plate P illustrated in FIGS. 3 and 4, and the pair of trim cutters 25*a* and 25*b* only cut the base material Ma without cutting through the release paper Mb.

The top plate 25*e* is formed as an integrated part of the pair of stoppers 25*c* and 25*d*, for example. The pair of stoppers 25*c* and 25*d* are formed protruding downwards from both ends of the bottom surface of the top plate 25*e* in the width direction (the Y direction).

Moreover, the pair of trim cutters 25*a* and 25*b* are attached to the top plate 25*e* and protrude downwards from the bottom surface of the top plate 25*e*.

As illustrated in FIG. 6, a cutting edge 26*a* is formed on the bottom end of the partial-cutting device 26 (for which only the cutter is illustrated in the figure), and the width w2 of this cutting edge 26*a* in the width direction (the Y direction) is less than the width w1 of the printing medium M.

Therefore, the partial-cutting device 26 only cuts through a portion of the printing medium M in the width direction (the Y direction) rather than cutting through the entire printing medium M in the width direction (the Y direction).

Moreover, the partial-cutting device 26 cuts through both the base material Ma and the release paper Mb. Note that here, if the cutting edge 26*a* of the partial-cutting device 26 is tapered downwards and the cut width can therefore be adjusted by adjusting the insertion depth when cutting the printing medium M, the full-cutting device 16 can be removed.

The trim-cutting device 25 and the partial-cutting device 26 are positioned such that the centers thereof in the width direction (the Y direction) are both aligned with the center of the printing medium M in the width direction (the Y direction). Therefore, the partial-cutting device 26 leaves both ends of the printing medium M in the width direction (the Y direction) uncut when cutting the printing medium M.

However, the partial-cutting device 26 may alternatively leave only one end in the width direction (the Y direction) uncut when cutting the printing medium M.

Moreover, the partial-cutting device 26 may alternatively include a cutter in which the cutting edge 26*a* is divided so that only the center portion in the width direction (the Y direction) is left uncut when cutting the printing medium M.

The trim-cutting device 25 is arranged further upstream in the conveyance direction (the X direction) than the partial-cutting device 26 (that is, towards the side opposite to the downstream side on which the feedout port 2*a* is arranged as illustrated in FIGS. 1, 3, and 4) but may alternatively be arranged further downstream.

Moreover, although the full-cutting device 16 and the half-cutting device 17 are illustrated in FIGS. 3 to 5, these components may be omitted in Embodiment 1.

Figure 9:
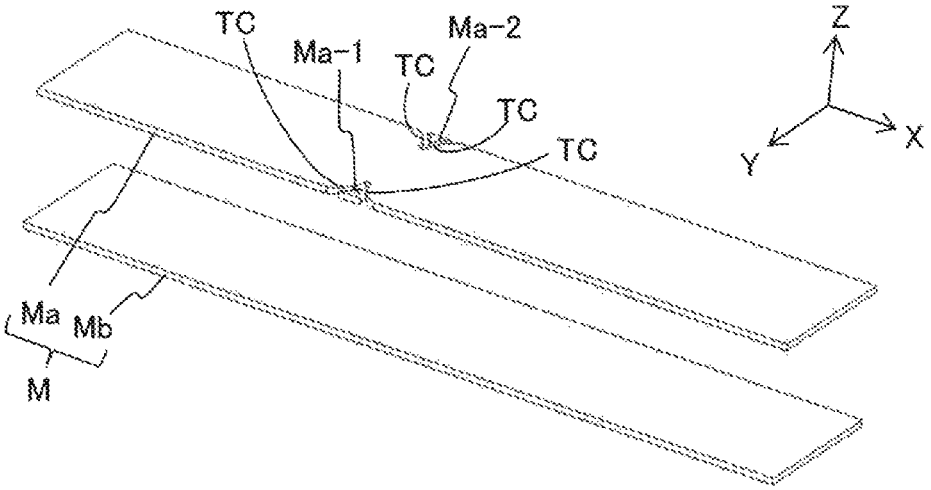
FIG. 9 is a (first) explanatory drawing for explaining a method of printing according to Embodiment 1.

As illustrated in FIG. 9, first, the trim-cutting device 25 makes trim cuts in the base material Ma of the printing medium M.

In this way, trim cuts TC are formed on both ends of the base material Ma in the width direction (the Y direction). Moreover, scraps Ma-1 and Ma-2 of the base material Ma that are cut out by the trim cuts TC remain adhered to the release paper Mb due to the base material Ma having the adhesive surface.

Note that for convenience, in FIGS. 9 and 10 the base material Ma and the release paper Mb are illustrated separated from one another in order to better show the trim cuts TC and a partial cut PC (described later).

Figure 10:
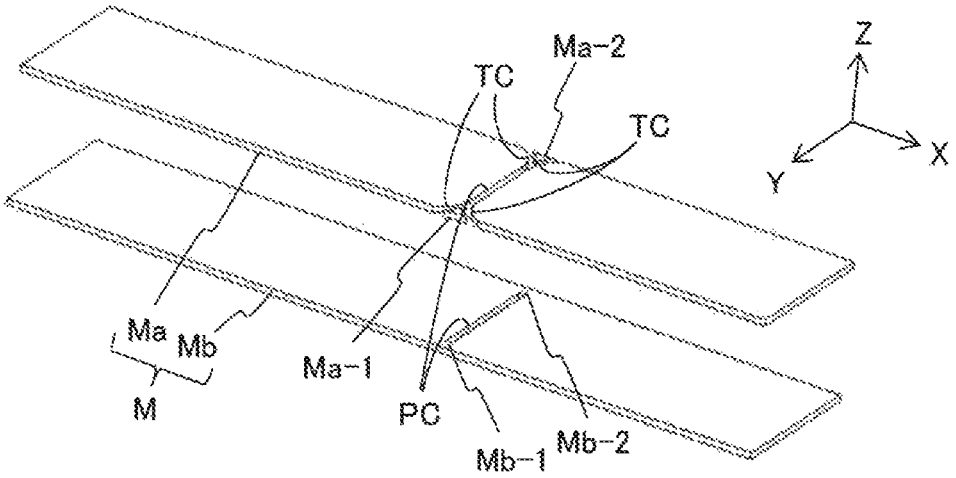
FIG. 10 is a (second) explanatory drawing for explaining the method of printing according to Embodiment 1.
Figure 11:
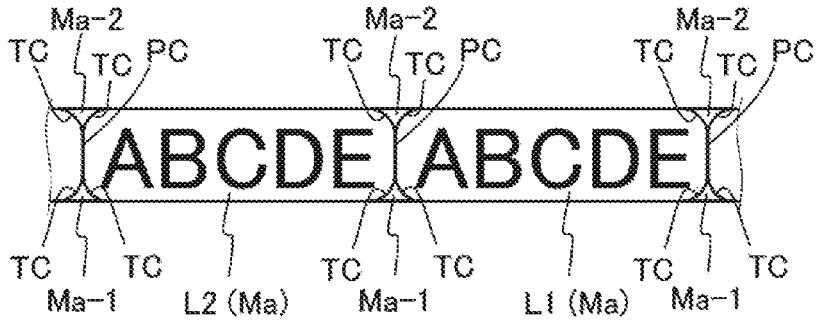
FIG. 11 is a (third) explanatory drawing for explaining the method of printing according to Embodiment 1.
Figure 12:
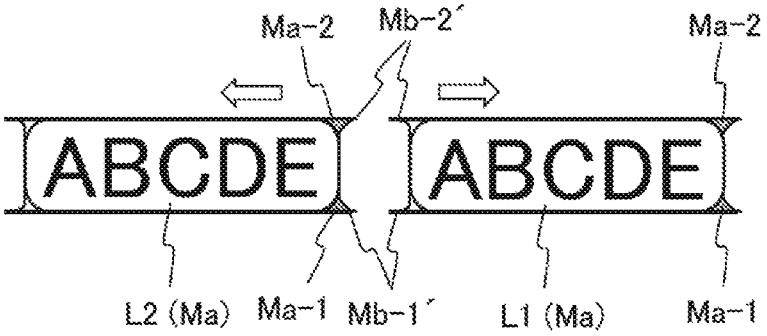
FIG. 12 is a (fourth) explanatory drawing for explaining the method of printing according to Embodiment 1.

Moreover, before the trim cuts are made, the thermal head 10 prints the text "ABCDE" as illustrated in FIGS. 11 and 12, for example, on the printing medium M in each of the regions where the labels will be made, although this text is not illustrated in FIG. 6, 9, or 10.

Next, the partial-cutting device 26 makes, at the same position in the conveyance direction (the X direction) at which the trim cuts TC were made, a partial cut through the entire portion of the printing medium M in the width direction (the Y direction) excluding where the trim cuts TC themselves are made.

In this way, as illustrated in FIG. 10, partial cuts PC are formed in both the base material Ma and the release paper Mb.

As illustrated in FIG. 11, forming the trim cuts TC and the partial cut PC in the base material Ma separates the labels L1 and L2 made in the regions on either side of the cuts from one another.

Moreover, the trim-cutting device 25 makes it possible to make the labels L1 and L2 with the four corners of each being cut off by the trim cuts.

Meanwhile, as illustrated in FIG. 10, uncut portions Mb-1 and Mb-2 are left remaining in the ends of the release paper Mb on either side of the partial cut PC in the width direction (the Y direction), and therefore the sides of the release paper Mb on either side of the partial cut PC remain connected.

To separate the release papers Mb on the rear surfaces of the labels L1 and L2 that are made from the base material Ma as illustrated in FIG. 11 and described above, if only the one label L1 has been fed out of the feedout port 2*a* of the printer 1, the user simply grasps and pulls off that label L1. If both labels L1 and L2 have been fed out of the feedout port 2*a*, the user grasps the two labels L1 and L2 on either side of the partial cut PC and then pulls them apart from one another.

In this way, as illustrated in FIG. 12, the release papers Mb are separated from one another at the ends (Mb-1' and Mb-2') near the uncut portions Mb-1 and Mb-2 where the release paper Mb extends in the pulling direction.

Here, the base material Ma has no such extending portions due to being completely separated in the width direction (the Y direction) by the trim cuts TC and the partial cut PC.

Moreover, the scraps Ma-1 and Ma-2 remain adhered to one of the pairs of uncut portions Mb-1' and Mb-1' or Mb-2' and Mb-2' where the release paper Mb is torn apart.

Figure 13:
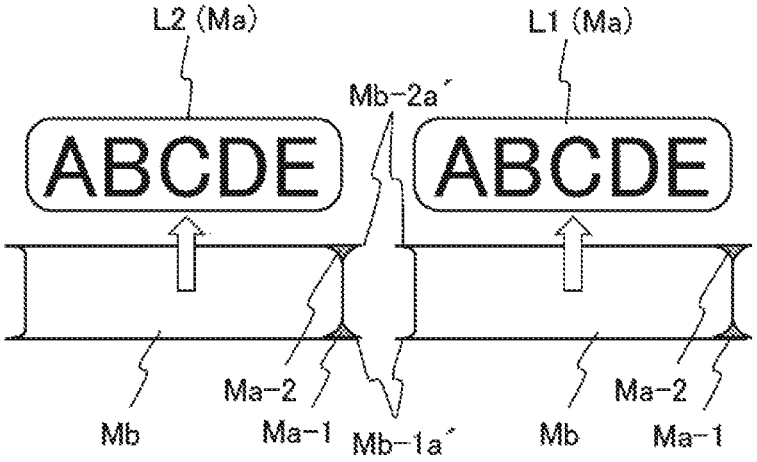
FIG. 13 is a (fifth) explanatory drawing for explaining the method of printing according to Embodiment 1.

Then, as illustrated in FIG. 13, the labels L1 and L2 can be peeled from the release papers Mb, and then the labels L1 and L2 can be applied to the desired target object utilizing the adhesive surface on the side opposite to the printing surface.

Figure 14:
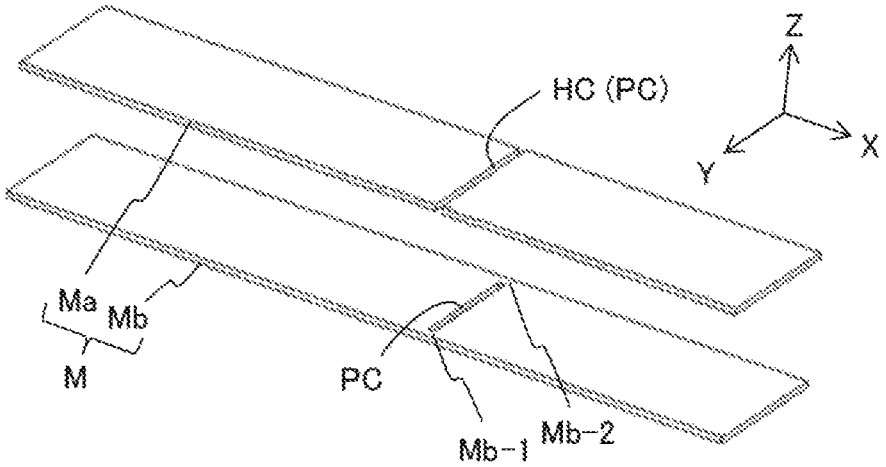
FIG. 14 is an explanatory drawing for explaining a method of printing according to a modification example of Embodiment 1.

FIG. 14 is an explanatory drawing for explaining a method of printing according to a modification example of Embodiment 1.

FIG. 14 illustrates another way in which labels can be made such that, as described above, only the release papers Mb have to be torn apart from one another and the labels that are made from the base material Ma do not have to be torn.

As illustrated in FIG. 14, in addition to forming the partial cuts PC through both the base material Ma and the release paper Mb as described above, before (or after) the partial cuts PC are formed, the half-cutting device 17 illustrated in FIGS. 3 to 5 may be used to make a half cut in just the base material Ma of the printing medium M in order to form a half cut HC at the same position in the conveyance direction (the X direction) at which the partial cuts PC is made.

When labels are made in this manner, the base material Ma is still completely separated in the width direction (the Y direction) by the half cut HC, and therefore no extending portions are left remaining on the labels when the release papers Mb are torn apart from one another.

In Embodiment 1 as described above, the printer 1 includes the thermal head 10 (an example of a printing device for printing on the printing medium M) that is arranged on the conveyance path along which the printing medium M is conveyed by the platen roller 21 (an example of a conveying device), as well as the trim-cutting device 25 (an example of a trim-cutting unit) that is also arranged on the conveyance path and cuts, into a desired shape, at least one of a plurality of corners of regions of the printing medium M where the labels L1 and L2 (examples of a printed material) will be made from that printing medium M.

This makes it possible to cut off the corners of the labels L1 and L2, which tend to be prone to peeling from the target object, without the user having to manually cut off the corners using scissors or the like after the labels L1 and L2 are made.

Therefore, Embodiment 1 makes it possible to give the corners of the made labels L1 and L2 a desired shape.

Moreover, in Embodiment 1, the printing medium M includes the base material Ma having an adhesive surface and the peelable release paper Mb that covers the adhesive surface, the labels L1 and L2 are made by using the thermal head 10 to print on the surface of the base material Ma on the side opposite to the adhesive surface, and the trim-cutting device 25 makes trim cuts in just the base material Ma of the printing medium M.

In this way, the scraps Ma-1 and Ma-2 of the base material Ma that are cut out by the trim cuts TC remain adhered to the release paper Mb due to the base material Ma having the adhesive surface, thereby making it possible to prevent these scraps Ma-1 and Ma-2 from remaining inside of the printer 1 as foreign material.

Furthermore, in Embodiment 1, the partial-cutting device 26 (an example of a partial cutting unit) that partially cuts the printing medium M in the width direction (the Y direction) that is orthogonal to the conveyance direction (the X direction) of the printing medium M makes, at the same position in the conveyance direction (the X direction) at which trim cuts (trim cuts TC) are made, a partial cut through the entire portion of the printing medium M in the width direction (the Y direction) excluding where the trim cuts TC themselves are made.

Therefore, unlike if the plurality of labels L1 and L2 were made sequentially and separated from one another by full cuts, the printing medium M remains connected at the uncut portions Mb-1 and Mb-2 of the release paper Mb, and therefore the label L1 is fed forward as the rest of the printing medium M moves forward and does not remain at the position at which the full cut was performed. This makes it possible to prevent the label L1 from causing resistance and potentially resulting in a jam as the printing medium M (the label L2) is conveyed.

Furthermore, when pulling apart the labels L1 and L2 that are connected together in this manner, the base material Ma from which the labels L1 and L2 are made is completely separated in the width direction (the Y direction) by the trim cuts TC and the partial cut PC, and therefore when the release papers Mb are separated from one another, this makes it possible to prevent extending portions from being left remaining on the labels L1 and L2 even if the user grasps the labels L1 and L2 on either side of the partial cut PC and pulls them apart from one another.

In addition, in the modification example of Embodiment 1 illustrated in FIG. 14, the half-cutting device 17 makes a half cut spanning the entire width direction (the Y direction) but only in the base material Ma (that is printed on) of the base material Ma and the release paper Mb. The partial-cutting device 26 partially cuts through at least the release paper Mb of the printing medium M in the width direction (the Y direction) at the same position in the conveyance direction (the X direction) at which the half cut (half cut HC) is made in the printing medium M.

Therefore, the printing medium M remains connected at the uncut portions Mb-1 and Mb-2 of the release paper Mb in this modification example as well, thereby similarly making it possible to prevent jams.

Furthermore, the base material Ma from which the labels L1 and L2 are made is completely separated in the width direction (the Y direction) by the half cut HC, and therefore when the release papers Mb are separated, this makes it possible to prevent extending portions from being left remaining on the labels L1 and L2 even if the user grasps the labels L1 and L2 on either side of the partial cut PC and pulls them apart from one another.

<Embodiment 2>

Figure 15:
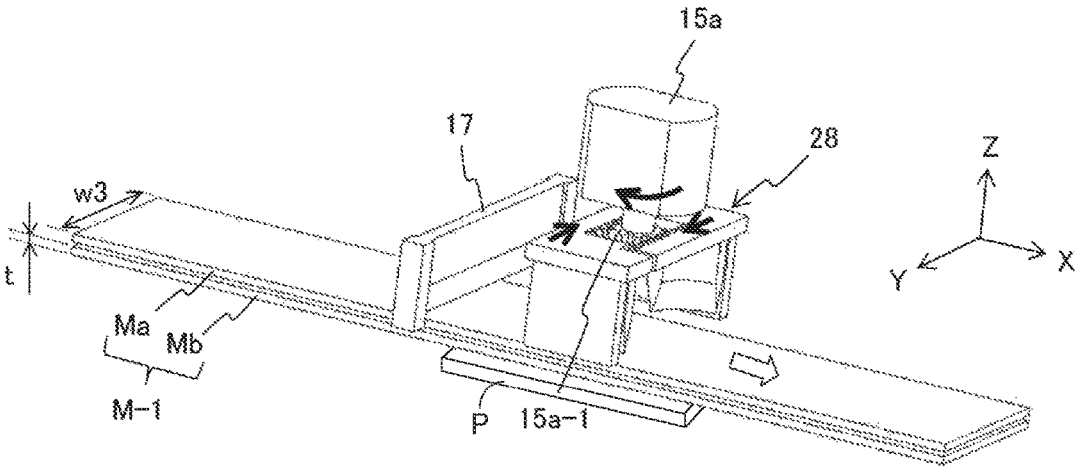
FIG. 15 is a (first) perspective view illustrating a trim-cutting device and a half-cutting device in Embodiment 2.
Figure 16:
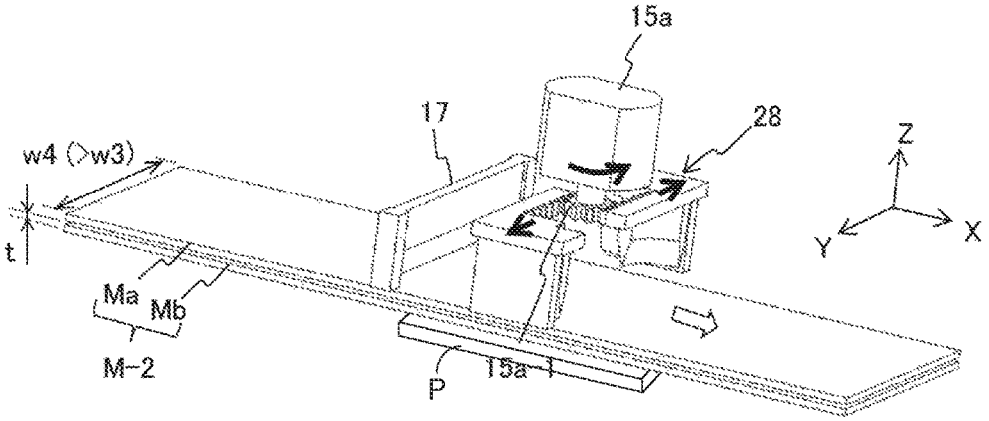
FIG. 16 is a (second) perspective view illustrating the trim-cutting device and the half-cutting device in Embodiment 2.

FIGS. 15 and 16 are perspective views illustrating a trim-cutting device (cutting device) 28 and a half-cutting device 17 in Embodiment 2.

Figure 17:
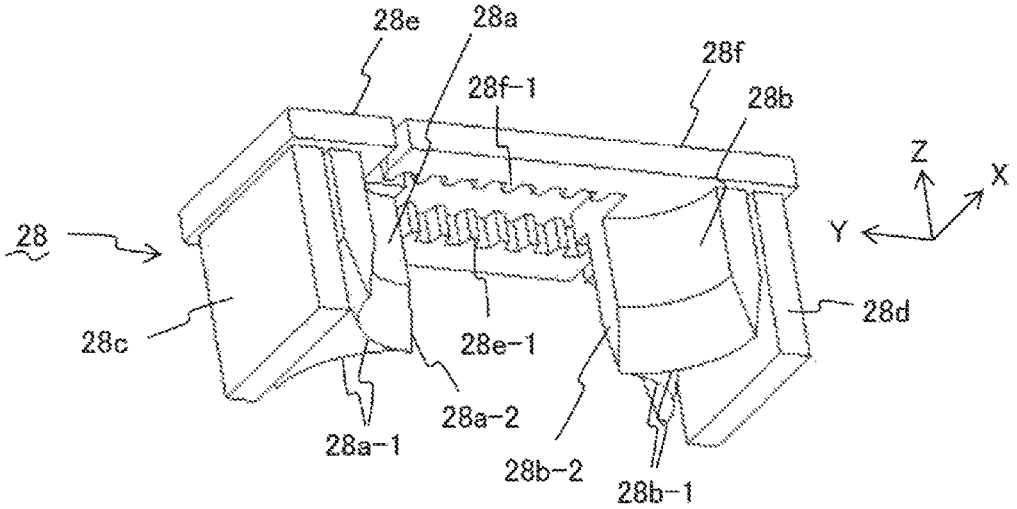
FIG. 17 is a lower perspective view illustrating the trim-cutting device in Embodiment 2.
Figure 18:
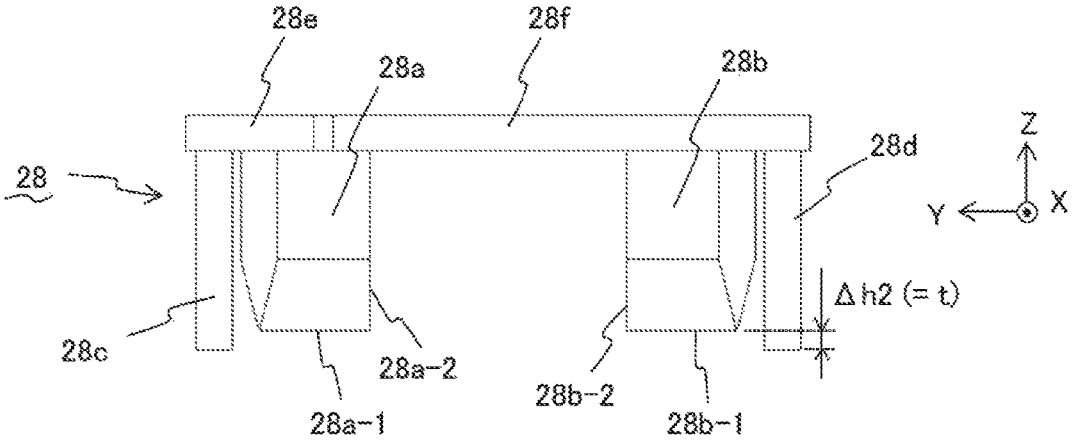
FIG. 18 is a front view illustrating the trim-cutting device in Embodiment 2.

FIGS. 17 and 18 are a lower perspective view and a front view illustrating the trim-cutting device 28.

Figure 19:
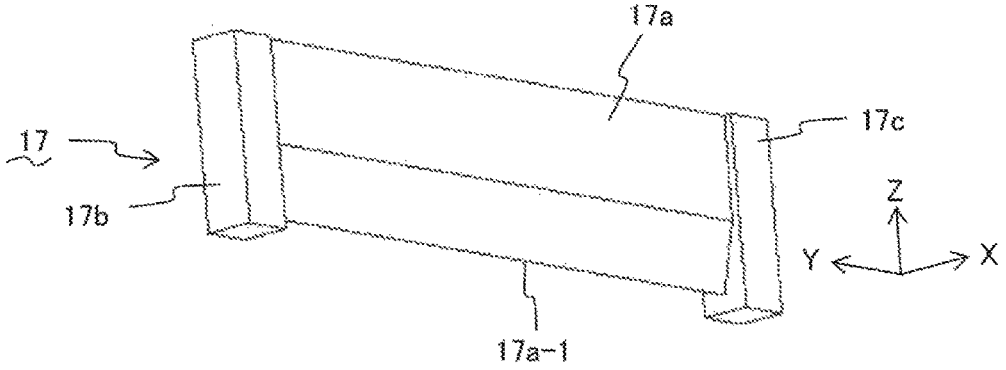
FIG. 19 is a lower perspective view illustrating the half-cutting device in Embodiment 2.
Figure 20:
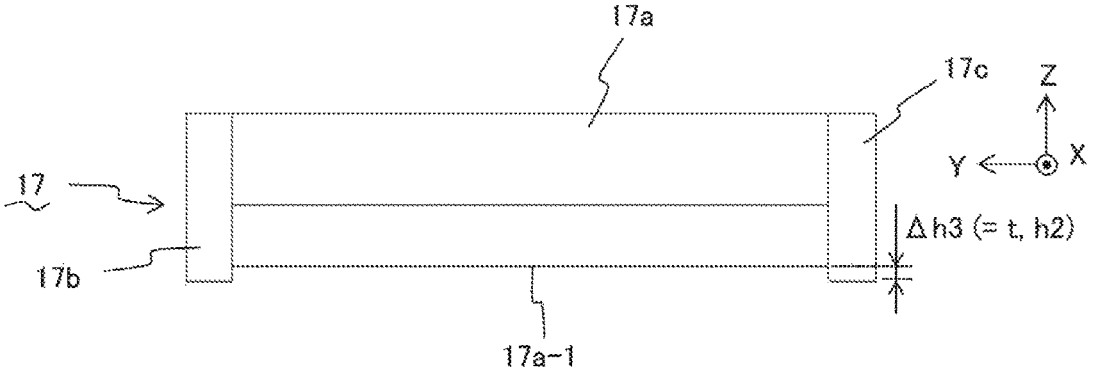
FIG. 20 is a front view illustrating the half-cutting device in Embodiment 2.

FIGS. 19 and 20 are a lower perspective view and a front view illustrating the half-cutting device 17.

FIGS. 21 to 24 are explanatory drawings for explaining a method of printing according to Embodiment 2.

As illustrated in FIGS. 17 and 18, the trim-cutting device 28 includes a pair of trim cutters 28*a* and 28*b* arranged facing one another in the width direction (the Y direction), a pair of stoppers 28*c* and 28*d* arranged facing one another in the width direction (the Y direction) and sandwiching the trim cutters 28*a* and 28*b*, and a pair of top plates 28*e* and 28*f*.

The pair of trim cutters 28*a* and 28*b* and the pair of stoppers 28*c* and 28*d* have the same shapes, respectively, as the pair of trim cutters 25*a* and 25*b* and the pair of stoppers 25*c* and 25*d* of the trim-cutting device 25 in Embodiment 1 and illustrated in FIGS. 7 and 8.

Thus, similar to the pair of trim cutters 25*a* and 25*b*, the pair of trim cutters 28*a* and 28*b* include cutting edges 28*a*-1 and 28*b*-1 and tips 28*a*-2 and 28*b*-2 on the inner sides.

The pair of stoppers 28*c* and 28*d* protrude further downwards (in the Z direction) than the pair of trim cutters 28*a* and 28*b* by a height Δh2. This height Δh2 is equal to the thickness t in the Z direction of a release paper Mb illustrated in FIGS. 15 16.

The pair of top plates 28*e* and 28*f* are respectively formed as integrated parts of the pair of stoppers 28*c* and 28*d*, for example.

The pair of stoppers 28*c* and 28*d* are formed protruding downwards from the pair of top plates 28*e* and 28*f*.

Moreover, the pair of trim cutters 28*a* and 28*b* are respectively attached to the pair of top plates 28*e* and 28*f* and protrude downwards from the bottom surfaces of those top plates 28*e* and 28*f*.

As illustrated in FIG. 17, teeth 28*e*-1 and 28*f*-1 are formed in the faces of the pair of top plates 28*e* and 28*f* that face one another in the conveyance direction (the X direction).

As illustrated in FIGS. 15 and 16, the teeth 28*e*-1 and 28*f*-1 mesh together with a gear 15*a*-1 positioned on the bottom end of a driving device 15*a*, thereby making it possible to move the pair of top plates 28*e* and 28*f* towards one another and away from one another in the width direction (the Y direction) while being guided along a guide member (not illustrated in the figures).

Note that here, the driving device 15*a* is one of the cutter motors 15 illustrated in FIG. 5.

After the trim-cutting device 28 makes trim cuts in the printing medium M-1 illustrated in FIG. 15, for example, to make trim cuts in the printing medium M-2 illustrated in FIG. 16, which has a width w4 that is greater than the width w3 of the printing medium M-1, the driving device 15*a* moves the pair of top plates 28*e* and 28*f* away from one another in the width direction (the Y direction), thereby making it possible to similarly move the pair of trim cutters 28*a* and 28*b* away from one another in the width direction (the Y direction).

In this way, the driving device 15*a* makes it possible to move at least one of the pair of trim cutters 28*a* and 28*b* and thereby change the distance between the pair of trim cutters 28*a* and 28*b* in the width direction (the Y direction).

Note that the driving device 15*a* may be controlled by a controller 5 illustrated in FIG. 5 in accordance with the width (tape width) of the printing medium M as detected by tape width detection switches 24.

Moreover, this type of driving device 15*a* for moving the pair of trim cutters 28*a* and 28*b* may be incorporated into Embodiment 1 as well.

The half-cutting device 17 illustrated in FIGS. 19 and 20 includes a half cutter 17*a* and a pair of stoppers 17*b* and 17*c* that are arranged on both ends of the half cutter 17*a* in the width direction (the Y direction). The pair of stoppers 17*b* and 17*c* protrude further downwards than a cutting edge 17*a*-1 formed on the bottom end of the half cutter 17*a* by a height Δh3.

This height Δh3 is equal to the thickness tin the Z direction of the release paper Mb illustrated in FIGS. 15 16 and is thus also equal to the height Δh2 of the trim-cutting device 28 as illustrated in FIG. 18 and described above.

Moreover, the cutting edge 17*a*-1 of the half-cutting device 17 is long enough in the width direction (the Y direction) to accommodate the widths of all of the types of printing mediums M that may be used in a printer 1, such as the printing medium M-2 illustrated in FIG. 16 that has the large width w4.

The trim-cutting device 28 and the half-cutting device 17 are positioned such that the centers thereof in the width direction (the Y direction) are both aligned with the centers in the width direction (the Y direction) of the various printing mediums M of different widths w3 and w4.

As illustrated in FIGS. 15 and 16, the trim-cutting device 28 is arranged further downstream in the conveyance direction (the X direction) than the half-cutting device 17 but may alternatively be arranged further upstream.

Moreover, unlike in FIGS. 3 and 4, a full-cutting device 16 is arranged further downstream in the conveyance direction (the X direction) than the half-cutting device 17 and the trim-cutting device 28.

Furthermore, the partial-cutting device 26 illustrated in FIGS. 3 to 5 may be omitted in Embodiment 2.

Figure 21:
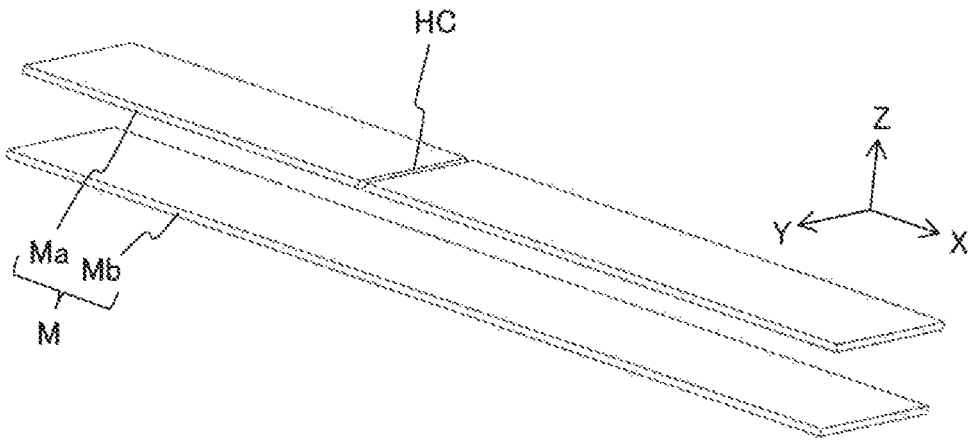
FIG. 21 is a (first) explanatory drawing for explaining a method of printing according to Embodiment 2.

As illustrated in FIG. 21, first, the half-cutting device 17 makes a half cut in a base material Ma of the printing medium M.

In this way, a half cut HC is formed through the entire base material Ma in the width direction (the Y direction).

Figure 22:
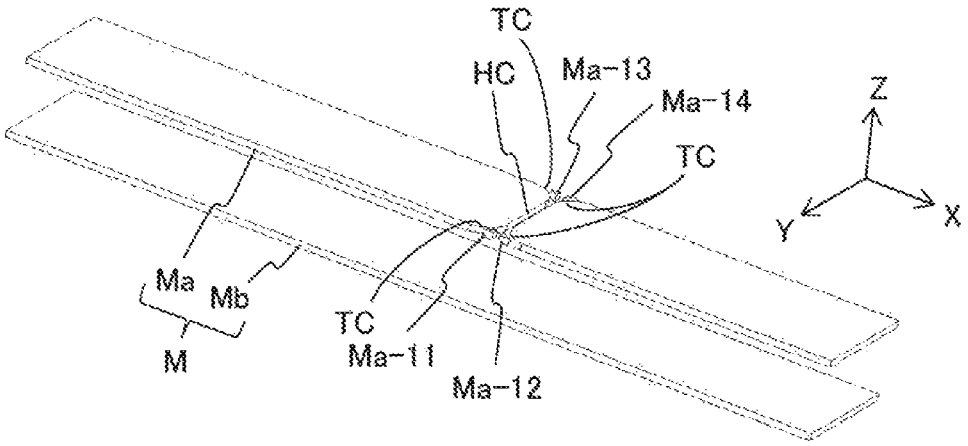
FIG. 22 is a (second) explanatory drawing for explaining the method of printing according to Embodiment 2.

Note that for convenience, in FIGS. 21 and 22 the base material Ma and the release paper Mb are illustrated separated from one another in order to show that the release paper Mb is not cut.

Figure 23:
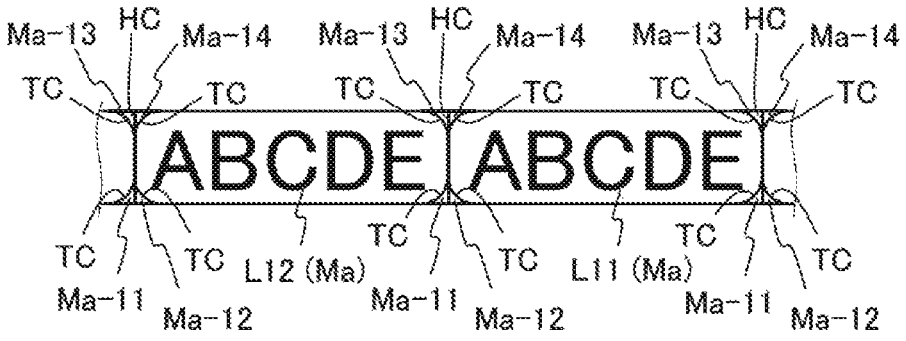
FIG. 23 is a (third) explanatory drawing for explaining the method of printing according to Embodiment 2.
Figure 24:
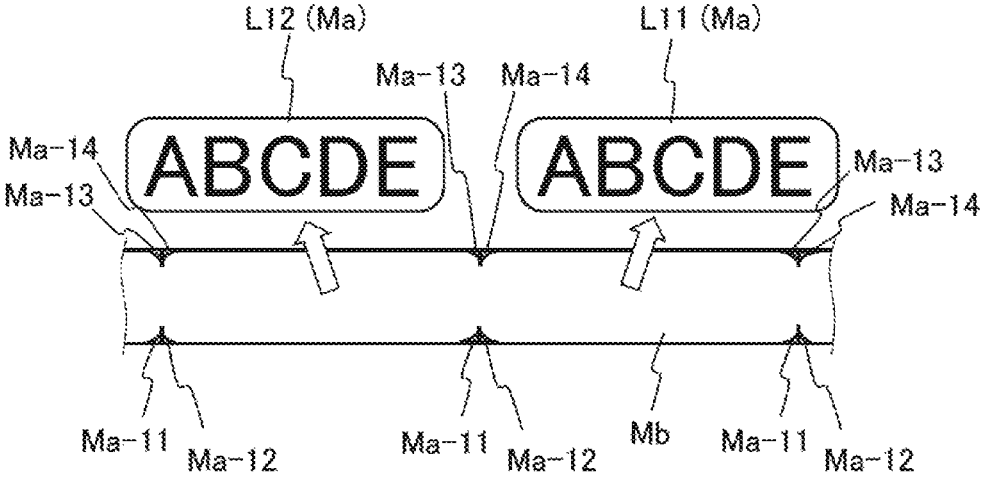
FIG. 24 is a (fourth) explanatory drawing for explaining the method of printing according to Embodiment 2.

Moreover, before the half cut is made, a thermal head 10 prints the text "ABCDE" as illustrated in FIGS. 23 and 24, for example, on the printing medium M in each of the regions where the labels will be made, although this text is not illustrated in FIG. 15, 16, 21, or 22.

Next, over a flat plate P, the trim-cutting device 28 makes trim cuts in the printing medium M at the same position in the conveyance direction (the X direction) at which the half cut HC was made.

In this way, trim cuts TC are formed on both ends of the base material Ma in the width direction (the Y direction).

Here, because the scraps Ma-11, Ma-12, Ma-13, and Ma-14 of the base material Ma that are cut out by the trim cuts TC are cut in half by the half cut HC, there are four scraps rather than two scraps as in Embodiment 1 (that is, twice as many). These scraps Ma-11, Ma-12, Ma-13, and Ma-14 remain adhered to the release paper Mb due to the base material Ma having the adhesive surface.

Note that the trim-cutting device 28 may also make trim cuts through both the base material Ma and the release paper Mb instead of just making trim cuts through the base material Ma.

As illustrated in FIG. 23, in two labels L11 and L12 made from the base material Ma as described above, half cuts HC are formed going through the entire base material Ma in the width direction (the Y direction) by the half-cutting device 17, and trim cuts are formed in the four corners by the trim-cutting device 28. Therefore, as illustrated in FIG. 24, the labels L11 and L12 can be peeled from the release papers Mb, and then the labels L11 and L12 (in which the corners are trimmed off) can be applied to the desired target object utilizing the adhesive surface on the side opposite to the printing surface. Moreover, the scraps Ma-11, Ma-12, Ma-13, and Ma-14 remain adhered to the release paper Mb.

In Embodiment 2 as described above, the trim-cutting device 28 makes the trim cuts in the printing medium M at the same position in the conveyance direction (the X direction) at which the half cuts HC are made. Alternatively, however, a setting for enabling/disabling trim cuts by the trim-cutting device 28 may be configured on the input device 3 illustrated in FIGS. 1 and 5 or on an input device of a computing device for making printing content or the like that is connected via a wired or wireless connection to the printer 1. In this case, the controller 5 illustrated in FIG. 5 can then control the trim-cutting device 28 in accordance with this setting.

Figure 25:
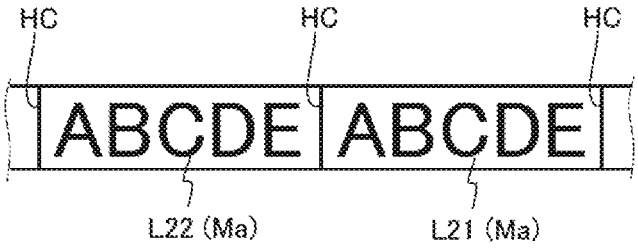
FIG. 25 is an explanatory drawing for explaining the method of printing according to Embodiment 2 when trim cuts are disabled.
Figure 26:
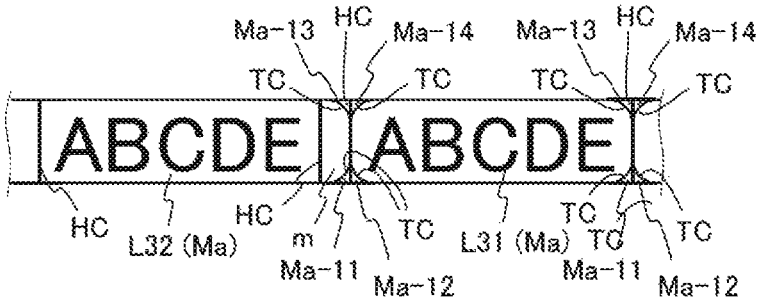
FIG. 26 is an explanatory drawing for explaining the method of printing according to Embodiment 2 when trim cuts are switched from being enabled to being disabled.
Figure 27:
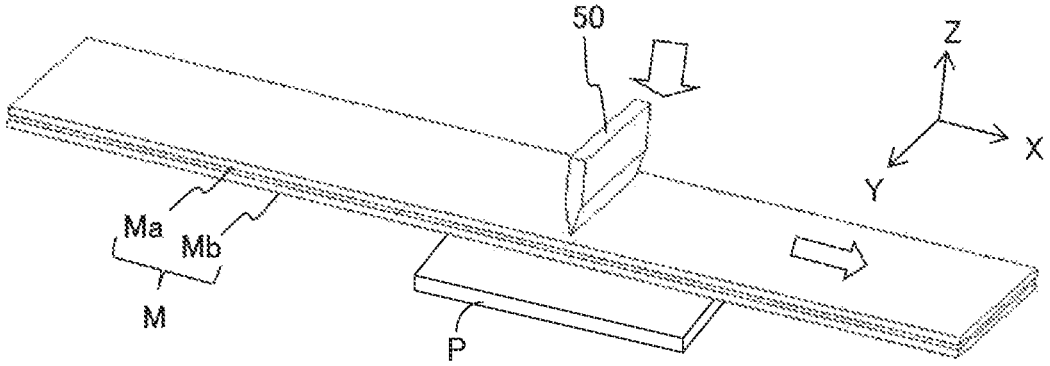
FIG. 27 is a (first) explanatory drawing for explaining a method of printing according to a conventional technology.
Figure 28:
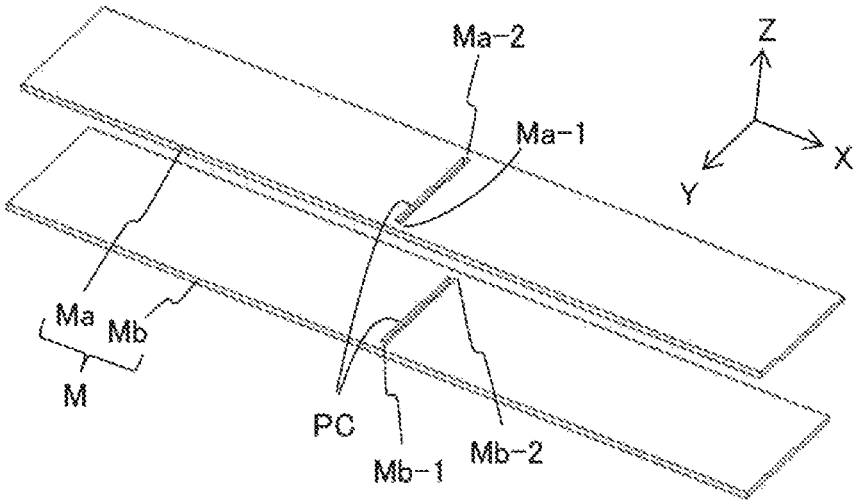
FIG. 28 is a (second) explanatory drawing for explaining the method of printing according to the conventional technology.
Figure 29:
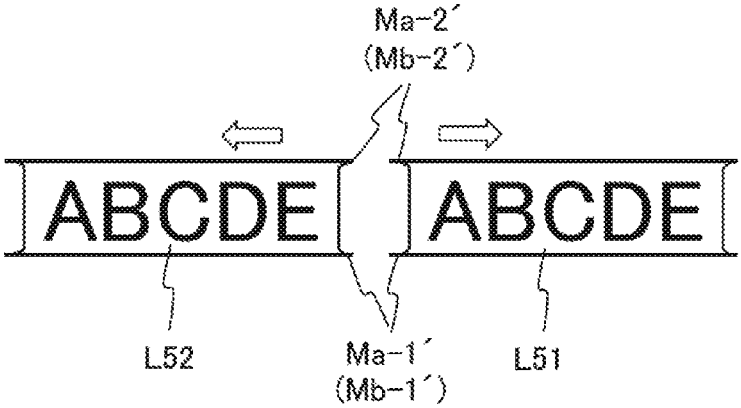
FIG. 29 is a (third) explanatory drawing for explaining the method of printing according to the conventional technology.

As illustrated in FIG. 25, when trim cuts are disabled and only half cuts are made, only a half cut HC is formed between two made labels L21 and L22.

Moreover, when trim cuts are switched to being disabled while continuously making printed materials with both trim cuts and half cuts enabled, in order to prevent a trim cut from being made in a region of the printing medium M where a label L32 (a second printed material) will be made after the last label L31 (a first printed material) for which trim cuts were enabled is made, the controller 5 leaves a blank portion m of the printing medium M between the region for the label L31 and the region for the label L32 when making the label L32.

To form this blank portion m, the printing position of the label L32 must be shifted by an amount corresponding to the blank portion m, and therefore the controller 5 controls at least a conveying device and the thermal head 10.

Moreover, the half-cutting device 17 makes a half cut between the blank portion m and the label L32. Therefore, the controller 5 also controls the half-cutting device 17. Note that the controller 5 may alternatively control the full-cutting device 16 in order to make a full cut instead of a half cut between the blank portion m and the label L32.

Implementing these control processes to form the blank portion m prevents trim cuts TC from being formed only in two of the four corners of the label L32 with the other two corners being left as right angles, thereby making it possible to make the label L32 to be left-right symmetric.

Similar to in Embodiment 1, in Embodiment 2 as described above, the trim-cutting device 28 cuts, into a desired shape, the corners of the regions of the printing medium M where the labels L11 and L12 (examples of a printed material) will be made from that printing medium M, thereby making it possible to give the corners of the made labels L11 and L12 that desired shape.

Moreover, similar to in Embodiment 1, in Embodiment 2 the trim-cutting device 28 makes the trim cuts only in the base material Ma of the base material Ma and the release paper Mb. In this way, the scraps Ma-11, Ma-12, Ma-13, and Ma-14 of the base material Ma that are cut out by the trim cuts TC remain adhered to the release paper Mb due to the base material Ma having the adhesive surface, thereby making it possible to prevent these scraps Ma-11, Ma-12, Ma-13, and Ma-14 from remaining inside of the printer 1 as foreign material.

Furthermore, in Embodiment 2, the trim-cutting device 28 makes the trim cuts in the printing medium M at the same position in the conveyance direction (the X direction) at which the half cuts (half cuts HC) are made. This makes it possible to separate the plurality of labels L11 and L12 (in which the corners are cut off by the trim cuts) from one another by the half cuts HC.

In addition, in Embodiment 2, the controller 5 controls the trim-cutting device 28 in accordance with a setting for enabling/disabling trim cuts by the trim-cutting device 28.

Here, when trim cuts are switched to being disabled while continuously making labels L31 and L32 with both half cuts and trim cuts being made in the printing medium M at the same position in the conveyance direction (the X direction), in order to prevent a trim cut from being made in a region of the printing medium M where the label L32 will be made after the last label L31 for which trim cuts were enabled is made, the controller 5 controls at least the thermal head 10 in order to leave a blank portion m of the printing medium M between the region for the label L31 and the region for the label L32. This makes it possible to prevent trim cuts TC from being formed only in two of the corners of the label L32 with the other two corners being left as right angles and thereby resulting in the making of a left-right asymmetric label L32.

Moreover, in Embodiment 2, the trim-cutting device 28 includes the pair of trim cutters 28*a* and 28*b* arranged facing one another in the width direction (the Y direction), and the driving device 15*a* makes it possible to move both (an example of at least one) of the pair of trim cutters 28*a* and 28*b* and thereby change the distance between the pair of trim cutters 28*a* and 28*b* in the width direction (the Y direction). This makes it possible to make trim cuts in a plurality of types of printing mediums M-1 and M-2 of different widths w3 and w4.

Note that if the driving device 15*a* moves only one of the pair of trim cutters 28*a* and 28*b*, the trim-cutting device 28 and the plurality of types of printing mediums M of different widths w3 and w4 are not arranged such that the centers thereof in the width direction (the Y direction) are aligned. Instead, the position of one end of the printing medium M in the width direction (the Y direction) is fixed, and the position of one of the trim cutters 28*a* and 28*b* of the trim-cutting device 28 is similarly fixed to align with this end.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A printer, comprising:

a conveying device that conveys, in a conveyance direction, a printing medium that includes a base material having an adhesive surface and a surface opposite to the adhesive surface where the printing is performed, and a release sheet that is peelable and covers the adhesive surface;

a first cutting device that makes a half cut on the printing medium, spanning an entirety of the printing medium in a width direction that is orthogonal to the conveyance direction, the half cut cutting only the base material of the printing medium; and a second cutting device that makes, in at least the release sheet of the printing medium, a partial cut in a portion in the width direction of the printing medium at a same position in the conveyance direction relative to a position at which the half cut is made.

2. The printer according to claim 1, further comprising:

a third cutting device that makes a trim cut making a cut in at least one of a plurality of corners of regions in the printing medium that are separated by the half cut at the same position in the conveyance direction relative to the position at which the half cut is made.

3. The printer according to claim 2, wherein the conveying device conveys the printing medium to the respective first to third cutting devices before the respective cuts are made.

4. The printer according to claim 2, wherein the third cutting device makes the trim cut only in the base material of the printing medium.

5. The printer according to claim 2, wherein the third cutting device includes a pair of trim cutters that make trim cuts in the printing medium and are arranged facing each other in a width direction that is orthogonal to the conveyance direction of the printing medium such that a distance between the pair of trim cutters in the width direction is changeable, and wherein the printer includes a driving device that moves at least one of the pair of trim cutters so as to change the distance between said pair of trim cutters in the width direction in accordance with a length in the width direction of the printing medium.

6. The printer according to claim 1, further comprising:

a printing device that performs the printing on the printing medium.

7. A printer, comprising:

a conveying device that conveys, in a conveyance direction, a printing medium that includes a base material having an adhesive surface and a surface opposite to the adhesive surface where the printing is performed, and a release sheet that is peelable and covers the adhesive surface;

a first cutting device that makes a half cut on the printing medium, spanning an entirety of the printing medium in a width direction that is orthogonal to the conveyance direction, the half cut cutting only the base material of the printing medium; and a second cutting device that makes, in at least the release sheet of the printing medium, a partial cut in a portion in the width direction of the printing medium.

8. The printer according to claim 7, further comprising:

a third cutting device that makes a trim cut making a cut in at least one of a plurality of corners of regions in the printing medium that are separated by the half cut at a same position in the conveyance direction relative to the position at which the half cut is made.

9. The printer according to claim 8, wherein the conveying device conveys the printing medium to the respective first to third cutting devices before the respective cuts are made.

10. The printer according to claim 8, wherein the third cutting device makes the trim cut only in the base material of the printing medium.

11. The printer according to claim 8, wherein the third cutting device includes a pair of trim cutters that make trim cuts in the printing medium and are arranged facing each other in a width direction that is orthogonal to the conveyance direction of the printing medium such that a distance between the pair of trim cutters in the width direction is changeable, and wherein the printer includes a driving device that moves at least one of the pair of trim cutters so as to change the distance between said pair of trim cutters in the width direction in accordance with a length in the width direction of the printing medium.

12. The printer according to claim 7, further comprising:

a printing device that performs the printing on the printing medium.

* * * * *